United States Patent [19]

Kirjavainen

[11] 4,169,757

[45] Oct. 2, 1979

[54] APPARATUS FOR DAMPING PRESSURE FLUCTUATIONS IN PULP SUSPENSION FLOW OF PAPER MACHINES

[75] Inventor: Alvi Kirjavainen, Jyväskylä, Finland

[73] Assignee: Valmet Oy, Finland

[21] Appl. No.: 839,502

[22] Filed: Oct. 5, 1977

[30] Foreign Application Priority Data

Oct. 5, 1976 [FI] Finland ..... 762826
May 26, 1977 [FI] Finland ..... 771693

[51] Int. Cl.[2] ..... D21F 1/06

[52] U.S. Cl. ..... 162/380; 138/26; 138/30

[58] Field of Search ..... 162/340, 380; 138/30, 138/26; 137/207

[56] References Cited

U.S. PATENT DOCUMENTS

| | | | |
|---|---|---|---|
| 2,448,118 | 8/1948 | Pellettere | 138/30 |
| 3,473,565 | 10/1969 | Blendermann | 138/30 X |
| 3,563,852 | 2/1971 | Rojecki | 162/340 X |
| 4,030,971 | 6/1977 | Justus | 162/340 X |

*Primary Examiner*—Richard V. Fisher
*Attorney, Agent, or Firm*—Steinberg & Blake

[57] ABSTRACT

An apparatus for damping pressure fluctuations in the pulp-suspension flow of a paper machine includes a pipe system which delivers the pulp suspension to a headbox and in the interior of which the pulp suspension flows toward the headbox. A portion of the pipe system is surrounded by a gas, such as air, which is under pressure and which is situated within a suitable enclosure. This portion of the pipe system is formed at least in part by an elastic wall structure, the inner surface of which engages the pulp-suspension flow and the outer surface of which is exposed to the gas under pressure. Thus, the elastic wall structure changes its configuration or geometry due to pressure fluctuations in the pulp-suspension flow while the gas under pressure which acts through the elastic wall structure on the pulp suspension serves to damp the pressure fluctuations.

8 Claims, 14 Drawing Figures

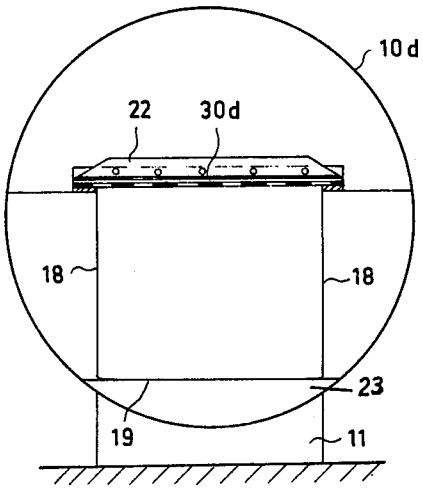
FIG. 6
FIG. 7
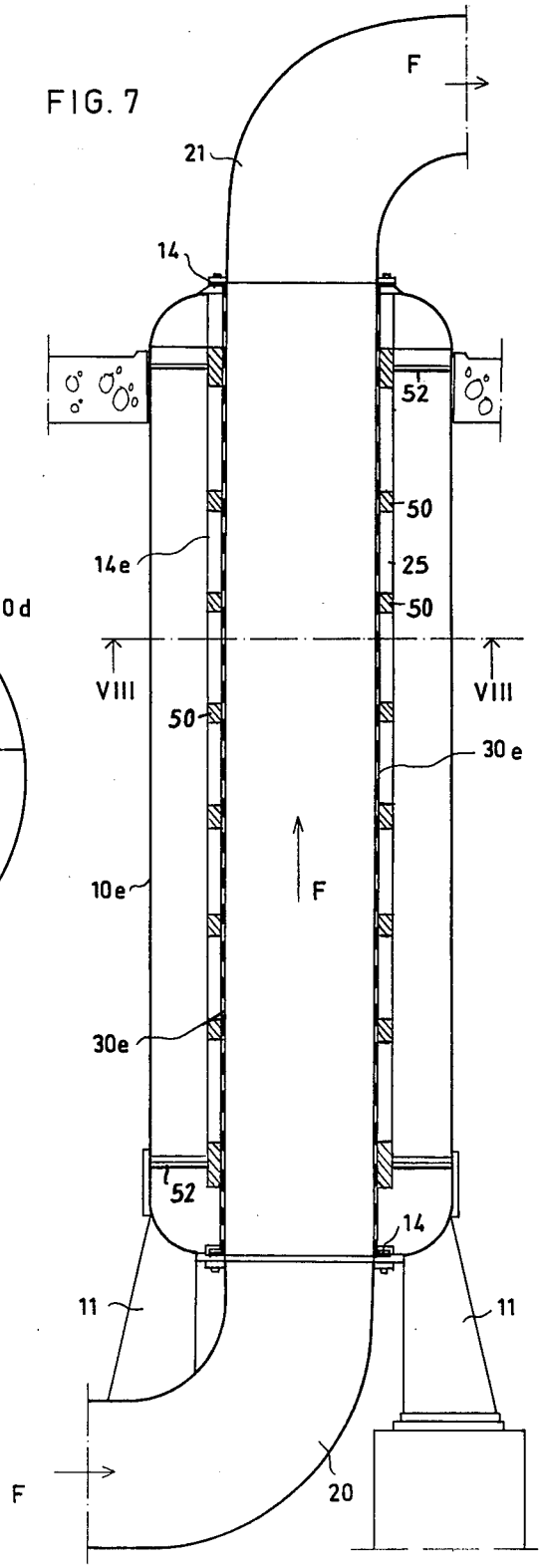

APPARATUS FOR DAMPING PRESSURE FLUCTUATIONS IN PULP SUSPENSION FLOW OF PAPER MACHINES

BACKGROUND OF THE INVENTION

The present invention relates to paper machines.

As is well known, in such machines the pulp suspension or pulp stock from which the paper is manufactured is delivered by a pipe system to a headbox, and the present invention is primarily concerned with apparatus for damping pressure fluctuations in the stock suspension which flows along the interior of the pipe system to the headbox.

As is well known, the pulp suspension flowing in the pipe system to the headbox is exposed to pressure fluctuations, for a number of reasons, and these fluctuations if transmitted all the way to the lip slice of the headbox will result in lack of uniformity in the paper which is manufactured. The situation with respect to such pressure fluctuations is ideal when throughout the entire lip slice of the headbox there is a suspension flow in which the quantity of dry matter suspended is uniform while the velocity of flow is constant. If this flow is uniform over the entire width of the slice but varies with passage of time, then in the longitudinal direction of the paper machine there will be variations in the dry weight of the paper.

If the pulp suspension flow is maintained constant with respect to time but is different at different locations along the width of the paper machine, then there will be a transverse variation of weight in the dry content of the paper. This type of variation is not damped by way of the present invention, nor by way of any other known damping systems acting at the pipe system which delivers the stock to the headbox, but transverse equalization can be taken care of by proper adjustment of the lip slice through suitable known spindles which are available for providing a fine adjustment of the depth of the lip slice across the width thereof.

If the pulp stock flow, when measured simultaneously at the entire aperture of the lip slice, is independent with respect to time and in addition, at any point across the width of the paper machine, is on the average equal over a relatively long interval but different from one point of time to another point of time, then there will be produced in the paper, across the breadth of the machine, randomly situated heavier and lighter areas, or so-called residual variation. Such variations are caused first as a result of turbulence vortices produced in the headbox and acting on the output flow rate and secondly by a small-scale non-uniform distribution of the dry matter in the pulp suspension.

This latter turbulence cannot be damped but is influenced by the particular design of the headbox. On the other hand, the small-scale dry matter distribution in the pulp suspension will indeed be equalized by way of the present invention in a manner which is superior to or at least equal in economy and efficiency to the best previously known designs.

The variation in the dry weight of the paper longitudinally, in the direction of the machine, is primarily caused by variation in the flow rate which occurs in the stock input to the headbox by way of the pipe system. Secondly, such variations are caused by pressure waves which are always present in the pipe system while being propagated with the velocity of sound, the latter variations being converted at the aperture of the slice into variations in the kinetic energy of the jet. In the third place these variations are caused by large-scale consistency variations in the stock supply pipe.

Thus, in summary, it is to be observed that the input fluctuation signals with respect to which the present invention is concerned are the dynamic pressure variations at the lip slice, while the output fluctuation signals are the variations in the hydrostatic pressure in the pipe system, variation of the pressure at the supply pump, variation in the pressure drop occurring in the flow, pressure pulses due to vibrations which are transmitted to the pipe system through the supports thereof, and pressure variations resulting from turbulence vortices particularly at valves, at bends in the pipe system, etc.

It has been found in practice that the different pressure fluctuation signals each have their own characteristic frequency spectrum which often is fairly wide. However, the pressure fluctuation signals of pumps, for example, are characterized by clearly observable peaks at frequencies consistent with the speed of rotation of the pump and its multiples and subharmonics.

Paper machine headboxes, as shown in the prior art, may be divided into three main groups, namely, (a) headboxes provided with an air cushion situated directly in the headbox, or so-called air cushion headboxes, (b) hydraulic headboxes provided with an air cushion separate from the headbox itself, wherein the air tanks are located either in the approach pipe system of the pulp suspension in advance of the distribution header or after the distribution header, and (c) hydraulic headboxes which have no air cushions at all.

By utilizing air cushions in connection with the headbox, an attempt is made to equalize pressure variations occurring in the pulp suspension flow in advance of the lip slice, such pressure variations originating either in the stock system preceding the headbox or in the headbox itself.

In the air cushion headbox according to group (a), the damping of the pressure variations, during the passage of time, is in most cases highly efficient because in these cases the surface area of the flowing stock which is in contact with the air cushion is comparatively large, while the depth of the stock flow, measured at right angles to the flow direction, is relatively small. Such headboxes also have the advantage that in them the air cushion usually extends up to a location which is quite close to the discharge lip or slice of the headbox, so that at the region between the location where the air cushion acts and the slice the possibility of generation of new pressure fluctuations is at a minimum.

However, in spite of the above advantages of the group (a) type of headboxes, this type has in recent times been replaced in modern, fast paper machines by hydraulic or fully hydraulic headboxes as set forth above in groups (b) and (c). The reason for this is the easier accommodation of the latter types of headboxes in connection with the more modern twin-wire formers and on the other hand the lower manufacturing costs involved with groups (b) and (c). The greater turbulence of the stock jet discharging from the slice and the more favorable intensity distribution therein, together with the superior homogeneity of the stock resulting therefrom, have also promoted the use of these hydraulic headboxes. However, as against the above advantages thereof, hydraulic headboxes have displayed problems arising from the above pressure fluctuations. It has very often been necessary to provide a headbox originally intended to be fully hydraulic with one or more separate air tanks intended to replace the air cushion of an air cushion headbox. With respect to the location of these separate air tanks, various design solutions have been provided, and in some of them the air tanks have been connected to the pulp stock pipe system in advance of the headbox. In other known designs, the air tanks are situated above the headbox itself, being joined thereto by connecting pipes or by a connecting duct communicating with the upper part of the headbox.

Constructions of this latter type, however, have the drawback that in the air tank above the headbox the depth of the free liquid over the central axis of the liquid stream is relatively large, or the communicating pipes from the headbox to the air tank must be dimensioned so as to be relatively narrow as compared with the cross section of the main flow passage. In both of these cases the damping characteristics are substantially impaired, as compared with the pressure variation damping capability of the standard air cushion headbox.

SUMMARY OF THE INVENTION

It is accordingly a primary object of the present invention to provide a construction according to which the pressure fluctuations as referred to above can be damped in a manner which is superior to previously known solutions, particularly with regard to efficiency and economy.

Thus, it is one of the important objects of the present invention to provide an apparatus capable of effectively damping pressure fluctuations which occur in the pulp suspension flow in the pipe system which is situated in advance of the distribution header of the headbox.

A further object of the present invention is to provide a pressure-fluctuation damping construction of simple design capable of being accommodated in various available spaces, even if the latter are relatively limited.

In addition it is an object of the present invention to provide a damping apparatus which has the largest possible damping area so as to bring about in this way as efficient a damping of the pressure fluctuations as possible.

Yet another object of the present invention is to provide a damping apparatus which damps pressure fluctuations while altering the cross section of the pulp suspension flow in such a way that the change in the cross section of flow will also act to damp pressure fluctuations.

An additional object of the present invention is to provide a damping apparatus enabling the pulp suspension to be delivered to the headbox in a uniform manner and with minimum turbulence.

The objects of the present invention also include the provision of an apparatus which will prevent air from being mixed in which the pulp suspension. In other words, it is an object of the present invention to provide an apparatus which will maintain the stock suspension closed off from air or other gas under pressure which is used for damping purposes.

With known paper machines, the headboxes often are adjustable so that their position can be changed, and it is a still further object of the present invention to provide a highly effective connection of the damping structure into the system in such a way that the adjustment of the headbox can still be carried out effectively.

In connection with this latter feature involving an adjustable headbox, the adjusting movement of which is accompanied by at least part of the pipe system which delivers the stock suspension to the headbox, it is already known to use elastic connecting structure which includes two comparatively long bellows which are joined by a relatively long intermediate tube. With this known type of elastic connecting structure there is at the location of the bellows a rigid inner pipe the diameter of which is somewhat smaller than the pipe which conveys the pulp suspension and which is assembled with the fixed intermediate pipe so that the latter pipes are situated partly one within the other. The drawback with this type of construction, especially when utilized in connection with the pulp stock supply of a headbox, is that there remains between an inner pipe and the bellows an annular space which is open to and communicates with the pulp stock pipe, so that the pulp stock can enter into this annular space. After a certain time, with this latter type of construction it is possible that the stock in the latter annular space forms clumps which become entrained into the pulp stock flow so that such clumps cause defects in the paper web.

It is thus a further object of the present invention to provide a construction which will avoid these latter drawbacks while at the same time serving to provide an elastic connecting structure to be used with the damping apparatus while at the same time requiring only an exceedingly small space and providing for the stock a flow which is smoother than has heretofore been possible.

In accordance with the invention the apparatus includes a pipe system for delivering the pulp suspension to a headbox with the suspension flowing along the interior of the pipe system. An enclosure means has a hollow interior for enclosing a gas such as air at a pressure greater than atmospheric pressure. The pipe system includes an elastic wall means having an inner surface which defines part of the interior of the pipe system for engaging pulp suspension flowing therethrough, this elastic wall means having an outer surface which is exposed in the hollow interior of the enclosure means to the gas under pressure therein. This elastic wall means will respond to an increase in the pressure of the suspension with respect to the pressure of the gas so as to increase the cross section of the suspension flow where the suspension engages the elastic wall means. Also the elastic wall means will respond to a decrease in the pressure of the suspension with respect to the gas pressure in the enclosure means for decreasing the cross section of flow of the suspension so that through the elastic wall means pressure fluctuations in the flowing pulp suspension will be damped.

This elastic wall means includes, according to one embodiment of the invention, a tubular portion for surrounding the pulp-suspension flow and having an end fixed with a portion of the pipe system which is adjustably movable together with the headbox, the elastic wall means forming an extension of the latter portion of the pipe system. A flexible bellows means surrounds the elastic wall means at the region where it is connected to the above adjustable portion of the pipe system. This bellows means is fixed at one end together with the elastic wall means to the above portion of the pipe system and at an opposite end directly to the enclosure means. In this way an elastic connecting structure is provided for maintaining the damping of pressure fluctuations while at the same time providing for the possibility of adjustment of the headbox.

BRIEF DESCRIPTION OF DRAWINGS

The invention is illustrated by way of example in the accompanying drawings which form part of this application and in which:

FIG. 6 is a schematic transverse section of the apparatus of FIG. 5 taken along line VI—VI of FIG. 5 in the direction of the arrows;

FIG. 7 is a schematic sectional elevation in a plane containing the central axis of suspension flow and illustrating another embodiment of the invention where at least part of the suspension travels in a vertical direction;

DESCRIPTION OF PREFERRED EMBODIMENTS

Figure 1:
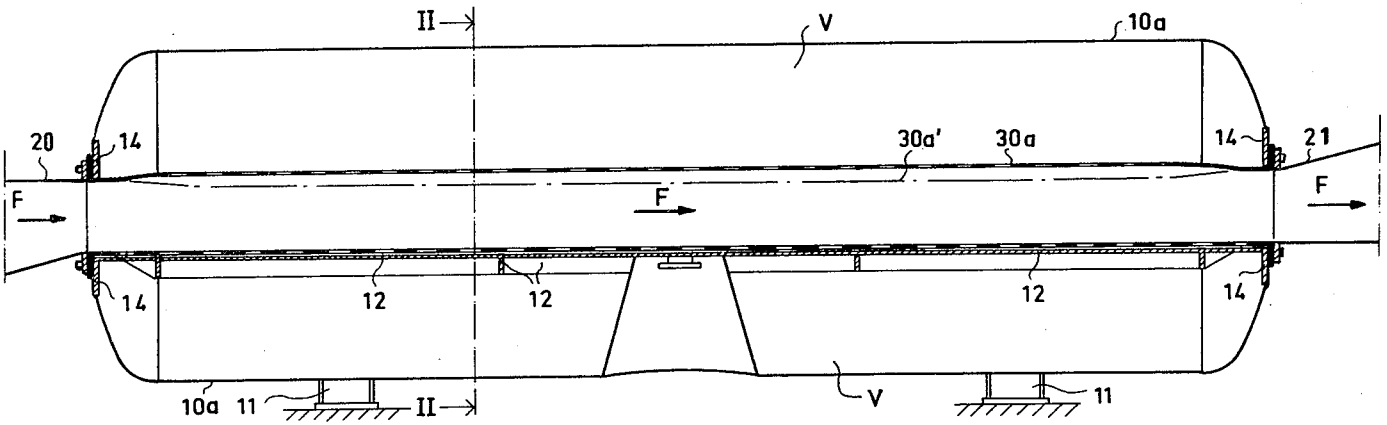
FIG. 1 is a schematic sectional elevation taken in a vertical plane which contains the axis of suspension flow and illustrating one embodiment of a damping apparatus of the invention.

Referring now to FIG. 1, there is schematically illustrated therein an enclosure means 10*a* in the form of air tank made, for example, of steel and enclosing within itself an air space V in which a gas such as air under pressure greater than atmospheric pressure is accommodated. A pipe system which supplies the pulp stock suspension to the headbox includes the fragmentarily illustrated pipe 20 which delivers the pulp suspension in the direction of the arrow F shown at the left of FIG. 1 toward the enclosure means 10*a* and a pipe 21 which is fragmentarily illustrated and continues the flow of the pulp suspension in the direction of the arrow F shown at the right of FIG. 1 toward the headbox, these pipes 20 and 21 of the pipe system being respectively fixed to opposite ends of the enclosure means 10*a* as illustrated.

In accordance with the invention the pipe system includes in the interior of the enclosure means 10*a* an elastic wall means which in the example of FIG. 1 takes the form of a tube 30*a*. This elastic wall means which takes the form of the tube 30*a* may be made, for example, of a fluid-impervious rubberized fabric. The tank or enclosure means 10*a* terminates at its opposed ends in a pair of endless wall portions 14, and the elastic tube or pipe 30*a* terminates at its opposed ends in a pair of outwardly directed flanges which engage the outer surfaces of the endless wall portions 14 of the tank 10*a*. The pipes 20 and 21 respectively terminate at their ends illustrated in FIG. 1 in outwardly directed flanges which engage the flanges at the end of the tube 30*a*, and suitable bolts or the like are used for connecting the flanges at the ends of the pipes 21 to the wall portions 14 of the tube 10*a* while compressing the flanges at the ends of the pipe 30*a* between the flanges at the ends of the pipes 20 and 21 and the end wall portions 14 of the tank 10*a*. In this way the tubular elastic wall means 30*a* is fluid-tightly connected with the pipes 20 and 21 while forming an extension thereof, providing for uninterrupted flow of suspension in the direction of the arrows F in FIG. 1 from the interior of the pipe 20 along the interior of the elastic tube 30*a* into the interior of the pipe 21, and at the same time in the interior of the enclosure means 10*a* it is possible for the elastic wall means 30*a* to expand and contract as described below in order to achieve the damping of pressure fluctuations in the flowing pulp suspension. The pulp suspension is delivered to the inlet end of the pipe 30*a* by the pipe 20 from a suitable pump while the outlet pipe 21 serves to participate in delivery of the pulp suspension to the headbox which is not illustrated.

Figure 2:
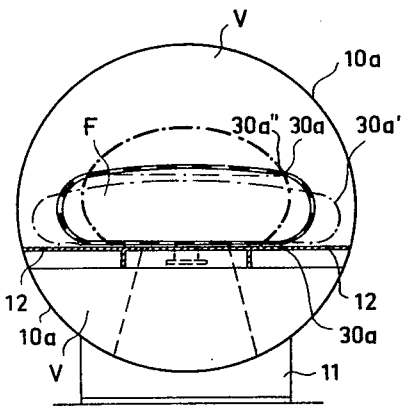
FIG. 2 is a schematic transverse section of the structure of FIG. 1 taken along line II—II of FIG. 1 in the direction of the arrows.

As is apparent from the cross-sectional schematic illustration in FIG. 2, it is possible for the tubular elastic wall means 30*a* to assume different cross-sectional configurations. Thus, the pressure of the gas within the enclosure means 10*a* will normally substantially equal the pressure of the suspension flowing through the tubular elastic means 30*a*. However, if the pressure of the flowing suspension increases with respect to the gas pressure then the tubular elastic wall means 30*a* can respond by automatically changing from the condition shown at 30*a* in FIG. 2 into the condition shown at 30*a*″, whereas if the pressure of the suspension drops the elastic wall means can automatically change its geometry to assume the configuration 30*a*′ indicated schematically in FIG. 2.

It can be seen from the above that the tubular elastic wall means which defines the part of the pipe system which is located within the interior of the enclosure means changes its cross-sectional configuration to equalize the pressures of the gas within the enclosure means and of the suspension flowing through the tubular elastic means whereby pressure fluctuations in the flowing pipe suspension will be damped. It should be noted that the tubular wall means which in the present embodiment is constructed of a fluid-impervious rubberized fabric, will not necessarily stretch or compress since a rubberized fabric (or other reinforced rubber structure) will generally not be distensible to any significant extent. Rather the change in the cross-sectional configuration of the flow passage occurs by way of the tubular elastic wall changing its geometrical shape through flexure or oscillation of the rubberized fabric wall in the absence of stretching.

In the illustrated example the enclosure means 10*a* carries in its interior a substantially rigid means for protecting and in this case supporting the elastic wall means 30*a*. In the illustrated example, this substantially rigid means includes a horizontal substantially flat wall 12 which extends across the interior of the enclosure means 10*a* and is situated directly beneath the tubular elastic wall means 30*a* for supporting the latter in the manner apparent from FIGS. 1 and 2. Thus the supporting wall 12 simply extends across the interior of the tank 10*a* and is supported at its opposite side edges at the inner surface of the tank 10*a*. This tank is itself carried by suitable supporting structure 11 situated, for example, on a floor.

Figure 3:
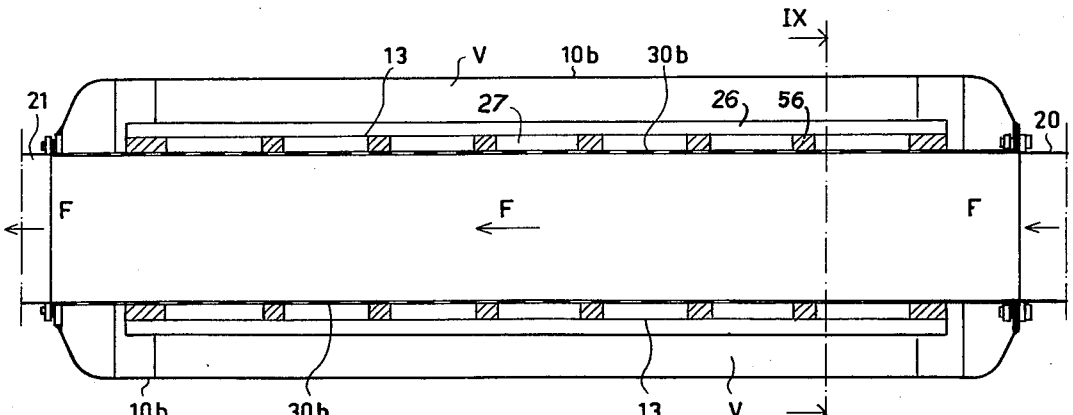
FIG. 3 is a schematic longitudinal sectional elevation, also taken in a vertical plane containing the axis of flow, and illustrating a further embodiment of the invention for damping pressure fluctuations while the suspension flows in a horizontal direction.
Figure 9:
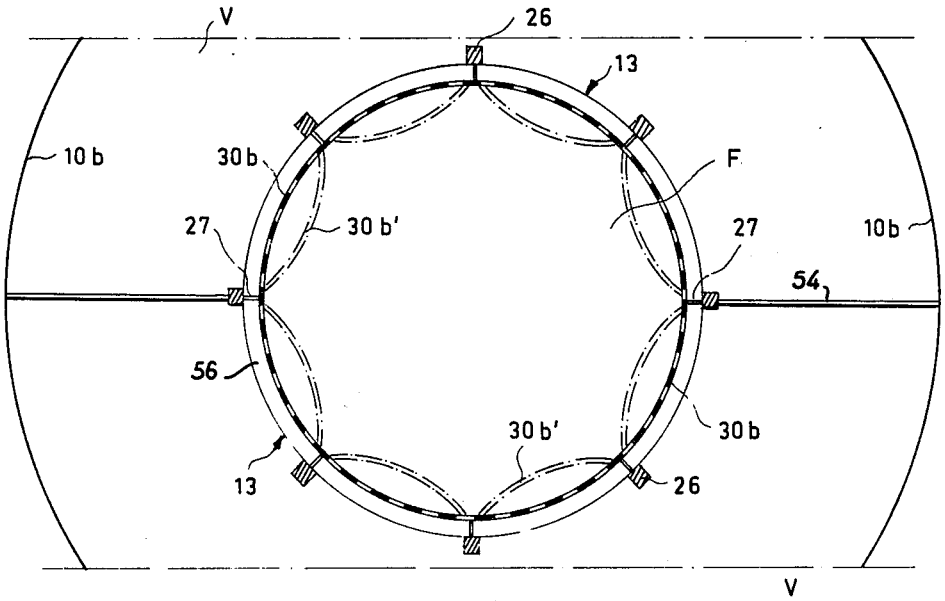
FIG. 9 is a transverse section of the structure of FIG. 3, taken line IX—IX of FIG. 3 in the direction of the arrows and schematically showing the structure fragmentarily at a scale larger than FIG. 3.

In the embodiment of FIG. 3, there is an enclosure means 10*b* which corresponds to the enclosure means 10*a* and operates in the same way while also being connected to the inlet pipe 20 and the output pipe 21 in the manner described above. This tank 10*b* of FIG. 3 is of a circular cross section and has in its interior a concentric elongated damping pipe 30*b* in the form of a tubular elastic wall means made, for example, of reinforced rubber and also having normally a circular cross section. The suspension flows horizontally as indicated by the arrows F. In this embodiment the tubular elastic wall means 30*b* is surrounded by a substantially rigid means 13 which serves to protect and support the elastic wall means 30*b* while at the same time permitting the latter to expand and contract or, in other words, oscillate radially outwardly and inwardly as best seen in FIG. 9. The details of the substantially rigid means 13 are set forth below in connection with FIG. 9.

Figure 4:
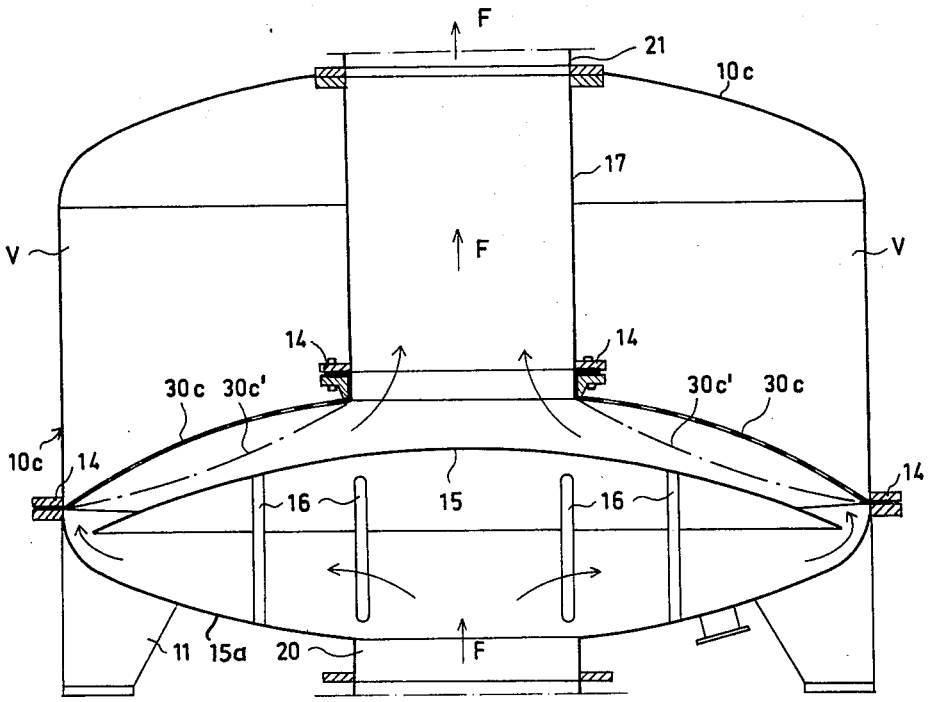
FIG. 4 is a schematic sectional elevation taken in a vertical plane containing the axis of suspension flow and illustrating a further embodiment of the invention where the suspension travels substantially in a vertical direction.

Referring now to FIG. 4, there is illustrated therein an embodiment of the invention where the pulp stock flows in a substantially vertical direction as indicated by the arrows F. The enclosure means 10*c* of this embodiment is in the form of a relatively low, vertical air tank. This air tank 10*c* terminates at its lower open end in an outwardly directed flange 14 which is fixed to a similar flange situated at the upper end of a lower supply pipe 20. This pipe 20 which receives the upwardly flowing suspension from the pump has at its upper end region an enlarged circular wall portion 15*a* which terminates in the upper end flange fixed to the flange at the bottom end of the tank 10*c*. Thus, this enlarged portion 15*a* of the pipe 20 may be considered as forming the bottom end of the tank 10*c*, although strictly considered this part 15*a* forms the upper portion of the pipe 20 inasmuch as the pulp suspension flows upwardly along the interior of the upper portion 15*a* of the pipe 20 while at the same time flowing in part radially outwardly from the smaller-diameter portion of the pipe 20 toward the outer wall of the tank 10*c*.

The inner concave surface of the enlarged pipe portion 15*a* has fixed thereto the bottom ends of a plurality of vertical rods 16 which carry at their top ends a baffle 15 of substantially circular dish-shaped configuration having a lower concave surface directed toward the upper concave surface of the enlarged pipe portion 15*a*. The outer peripheral edge of the baffle means 15 is situated inwardly of the upper portion 15*a* of the pipe 20 so that the suspension flows upwardly around the outer edge of the baffle means 15 to the upper surface thereof.

Situated above and spaced from the baffle means 15 is an annular elastic wall means 30*c* which has an outer peripheral portion clamped tightly between the flange 14 of the tank 10*c* and the flange at the upper end of the enlarged pipe portion 15*a*. This elastic wall means 30*c* thus has the configuration of an annular diaphragm, and it terminates in an inner circular peripheral portion which has a flange fixed to and engaging a flange 14 at the lower end of a pipe 17 situated in the interior of the tank 10*c* as illustrated. Below this flange 14 at the bottom end of the pipe 17 is a ring which surrounds the inner peripheral portion of the diaphragm and which is pulled tightly up toward the flange 14 at the bottom of the pipe 17 for fluid-tightly clamping a flange at the inner periphery of the diaphragm 30*c* to the bottom end of the pipe 17. This pipe is fixed at its top end to an upper circular wall portion of the tank 10*c*, so as to form in this way an extension of the outlet pipe 21. The circular pipe 17 is situated concentrically in the tank 10*c*.

Thus, with this embodiment of the invention the pulp suspension will flow through the space which is defined between the baffle means 15 and the elastic wall means 30*c* in a substantially radial direction inwardly toward and then into the pipe 17. The elastic wall means 30*c* can expand and contract or, in other words, oscillate outwardly and inwardly between the solid line position thereof shown in FIG. 4 and the dot-dash line position 30*c*'. Thus the elastic wall means 30*c* is free to oscillate and change its configuration as required in response to pressure variations and pressure pulses in the pulp suspension flow inasmuch as the outer or upper surface of the elastic wall means 30*c* is exposed to the air under pressure in the space V whereas the lower or inner surface of the elastic wall means 30*c* directly engages the flowing suspension. The particular embodiment shown in FIG. 4 is suitable for use in those situations where only a limited space, considered horizontally, is available for the structure of the invention.

Figure 5:
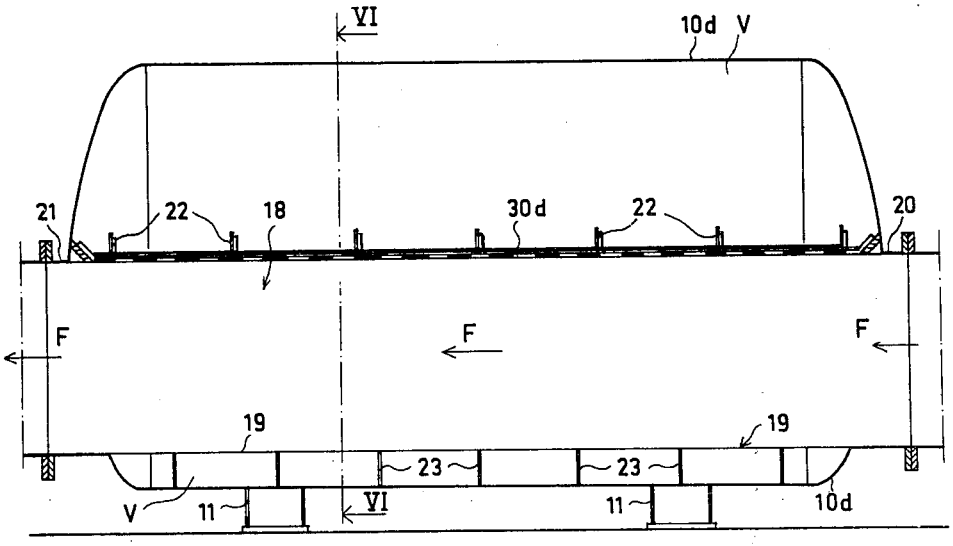
FIG. 5 is a schematic sectional elevation taken in a plane which contains the axis of suspension flow, with FIG. 5 illustrating a further embodiment of a damping apparatus of the invention wherein the damping is not applied completely around the flowing suspension.

In the embodiment of the invention which is shown in FIG. 5, there is also an enclosure means 10*d* for containing in its hollow interior V a gas such as air under pressure, with the supply and outlet pipes 20 and 21 extending horizontally while being connected to the opposed ends of the tank 10*d* in the manner shown schematically in FIG. 5. In this embodiment, the pipe system includes in the interior of the enclosure means 10*d* an elongated channel of U-shaped cross section having a substantially rigid bottom flat wall 19 and a pair of opposed upwardly directed side walls 18, as shown particularly in FIG. 6. Thus, this channel 18, 19, terminates in a pair of elongated upper side edges which are spaced from each other, and the elastic wall means 30*d* of this embodiment covers the channel 18, 19 while extending between and being situated in engagement with the upper free side edges of the side walls 18. Thus, only the top wall of the portion of the pipe system within the enclosure means 10*d* includes the elastic wall means of the invention in the embodiment of FIGS. 5 and 6. The substantially flat elastic wall means 30*d* of this embodiment has opposed side flanges which are respectively fixed fluid-tightly to the opposed flanges which extend outwardly from the side walls 18 at the upper edges thereof. In addition, this elastic wall means 30*d* is formed integrally with upwardly extending transverse ribs which are respectively fixed to transverse substantially rigid upright plates 22 which at their opposed ends are fixed together with the side edges of the wall means 30*d* to the flanges at the upper ends of the side walls 18. Thus, the elements 22 together with the ribs at the upper surface of the elastic wall means 30*d* extend transversely with respect to the direction of flow and serve to support and protect the elastic wall means 30*d*. The channel 18, 19 is itself supported by substantially rigid support members 23 which are schematically illustrated and which are situated in the interior of the tank 10*d* at the lower region thereof as illustrated.

In the embodiment of FIG. 7, the pipe system includes a curved supply or inlet pipe 20 and a curved outlet pipe 21. The upper end of pipe 20 and lower end of pipe 21 are are coaxial and fixed in the manner described above respectively to the lower and upper ends of a vertical enclosure means 10*e* which is supplied in its interior with a gas such as air under pressure. The pipe system of this embodiment includes in the interior of the enclosure means 10*e* the elongated elastic wall means 30*e* in the form of a pipe or tube the opposed ends of which are fluid-tightly connected in the manner described above to the inlet and outlet pipes 20 and 21. This vertical elastic-walled damping tube 30*e* is concentrically situated in the interior of the tank 10*e* and is surrounded by a substantially rigid means 14*e* in the form of a perforated or open-spaced protective tubular supporting structure which enables the exterior surface of the tubular elastic wall means 30*e* to be exposed to the gas under pressure within the enclosure means 10*e*.

Figure 8:
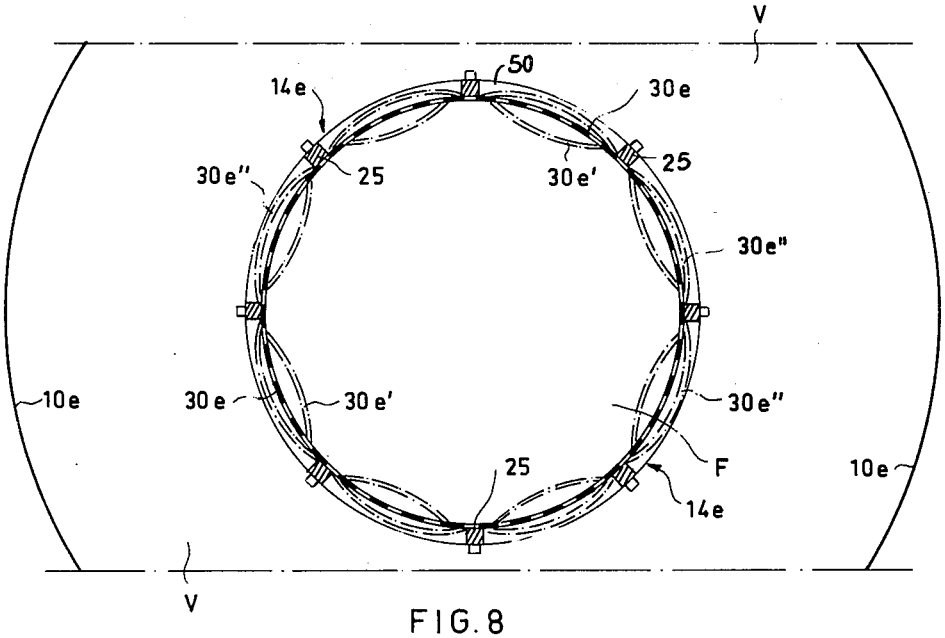
FIG. 8 is a fragmentary schematic transverse section of the apparatus of FIG. 7 taken along VIII—VIII of FIG. 7 in the direction of the arrows and showing the structure at a scale larger than FIG. 7.

The details of the substantially rigid protecting means 14*e* are illustrated in FIG. 8 which the details of the substantially rigid protecting means 13 of FIG. 3 are illustrated in FIG. 9. The substantially rigid means 13 and 14*e* serve to protect the tubular elastic wall means of FIGS. 3 and 7 both against air pressure surge and pressure surge of the pulp suspension. Referring to FIGS. 7 and 8 it will be seen that the substantially rigid means 14*e* includes a plurality of vertically extending rods or bars 25 which engage the outer surface of the elastic tube 30*e* while extending longitudinally thereof and being distributed circumferentially around the axis thereof. These vertical rods 25 are fixedly carried at their opposed end regions by horizontally extending rods 52 which are fixed at their inner ends to the rods 25 and at their outer ends to the inner surface of the tank 10*e*. Between these vertical rods 25 there are a plurality of arcuate bars 50 each of which is fixed at its opposed ends to the pair of rods 25 between which it extends, and these arcuate bars 50 are arranged in a series of circles longitudinally along the elastic pipe 30*e* in the manner apparent from FIGS. 7 and 8. Thus the vertical rods 25 and the arcuate bars 50 will define between themselves relatively large spaces in which the elastic wall means 30*e* can expand and contract or, in other words, radially oscillate outwardly and inwardly between the positions 30*e*'' and 30*e*' indicated in phantom lines in FIG. 8.

According to the embodiment of FIGS. 3 and 9, the substantially rigid means 13 includes a plurality of horizontally extending rods or bars 26 fixed to inner ends of radially extending rods 54 which at their outer ends are fixed to the inner surface of the tank 10*b*. These horizontally extending rods 26 are fixed to the adjoining ends of the arcuate bars 56 which are arranged in circles around the tubular elastic wall means 30*b* in the manner apparent from FIGS. 3 and 9. However, in this embodiment this tubular elastic wall means 30*b* is integrally formed at its outer surface with a plurality of radially extending fins 27 which extend longitudinally along the tubular elastic wall means 30*b* while projecting radially therefrom and being distributed circumferentially about the axis of the tubular wall means 30*b*. These fins 27 are clamped between the arcuate rods 56 so that in this way the elastic wall means 30*b* is protected by the substantially rigid means 13 while at the same time being free to expand and contract or, in other words, radially oscillate outwardly and inwardly as is apparent from the phantom line illustration 30*b*' shown in FIG. 9.

Thus, in each of the above-described embodiments, the tubular wall means will change its configuration by oscillating in response to the changes in pressure in the pulp suspension flow relative to the gas pressure in the associated enclosure means. The wall means, being formed of reinforced rubber, such as a rubberized fabric or equivalent, and therefore being substantially unstretchable, will expand and contract in the sense that it will change its geometrical configuration by flexing or oscillating to change the cross-sectional configuration of the flow passage defined thereby.

In all of the above-described embodiments of the invention, the compressed air situated within any of the enclosure means referred to above is maintained at a pressure which of course is substantially equal to the pressure of the pulp suspension flowing through the pipe system along the inner surface of the elastic wall means whose outer surface is exposed to the air under pressure. The purpose of the elastic wall means of any of the above embodiments is to damp out pressure fluctuations in the form of pulses or oscillations occurring in the flowing pulp suspension, and at the same time the elastic wall means of the invention will prevent the air under pressure from having access to the flowing suspension. The pulses or oscillations are efficiently damped out only by the air cushion formed in the interior air space V but also by the changing cross section of flow resulting from the change in geometry of the elastic wall means. Thus, in the event that the pressure of the pulp suspension flowing in the direction of the arrows F increases, then the flow cross section of the pulp suspension will also increase with the result that the velocity of flow decreases, thus achieving an equalizing effect. On the other hand, if the pressure of the flowing pulp suspension decreases, then the cross section of flow thereof defined in part by the inner surface of the elastic wall means of the invention will correspondingly decrease, so that the velocity of flow will correspondingly increase to achieve also in this case an equalizing effect. Thus, by changing the configuration of the cross section of the flow passage through which the pulp suspension travels, by way of the damping means of the invention, and in addition because the elastic wall means of the invention, engaged at its exterior surface by the air under pressure, extends parallel to the direction of suspension flow, it becomes possible to introduce the pulp stock into the headbox in a condition free of turbulence and with the greatest possible uniformity. In addition, connections required for control devices and other accessory equipment are capable of being conveniently arranged with the structure of the invention.

Referring now to FIGS. 10–14, the embodiments of the invention illustrated therein also include an enclosure means 110 in the form of a tank having an interior space V in which a gas such as air under pressure is situated. This tank 110 also is made, for example, of steel and communicates in any suitable way with a source of compressed air. Through the enclosure means 110 there extends a damping tube made, for example, of a fabric in the form of a reinforced rubber sheet material. In the pipe system illustrated in FIG. 10, one end of the tubular elastic wall means which extends horizontally through the tank 110 is connected with the outlet pipe 122 by way of an elastic connecting means 130*a* of the invention. In the example shown in FIG. 10, the opposite end of the tubular elastic wall means in the interior of the tank 110 is connected through an elastic connecting means 130' with the adjoining end of the inlet or supply pipe 121 of the illustrated pipe system. This elastic connecting means 130' may be identical with the elastic connecting means 130*a* and serves primarily to render possible a proper longitudinal fitting or mounting of the inner elastic tubular wall means 113 in the interior of the tank 110 in a highly favorable manner.

Figure 10:
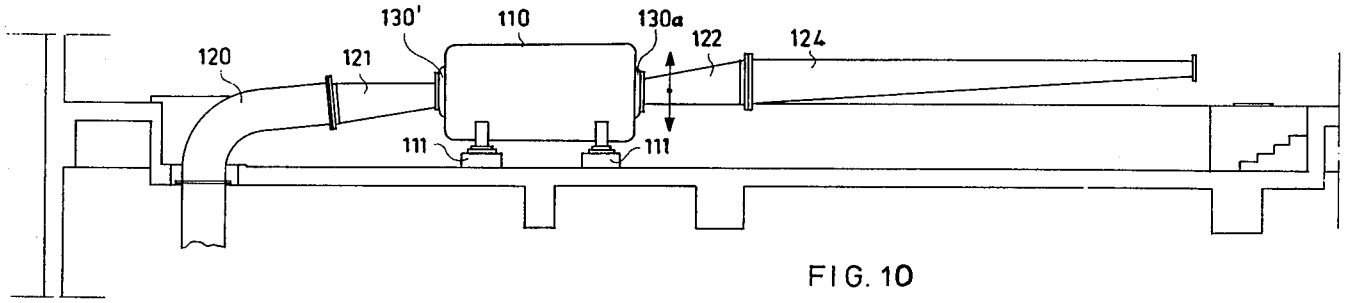
FIG. 10 is a schematic side elevation of a pipe system and damping apparatus of the invention with the pipe system including a portion which is adjustable for rendering the headbox adjustable.
Figure 11:
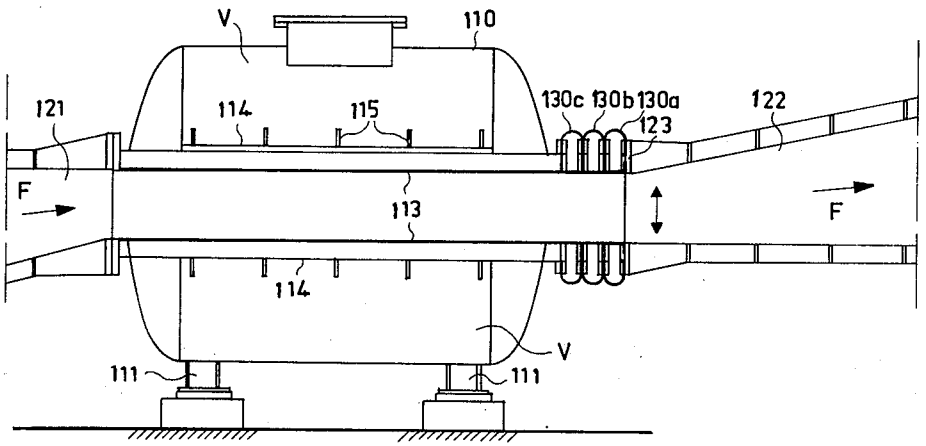
FIG. 11 is a schematic sectional elevation of that part of the structure of FIG. 10 which includes the damping apparatus of the invention as well as the apparatus of the invention for connecting the adjustable structure to the damping apparatus.

Referring to FIGS. 10 and 11, the pulp suspension flows in the direction of the arrows F shown in FIG. 11 and is supplied from a pump by way of the inlet pipe 120 into the tapered pipe 121 which terminates at its right end, as viewed in FIGS. 10 and 11, in a flange which while it can be connected directly to the tank 110 is instead connected as illustrated by way of the elastic connecting means 130' on the one hand to the tank 110 and on the other hand to the inlet end of the tubular wall means 113 which is shown schematically in FIG. 11. After traveling through the elastic tubular wall means 113 the pulp stock reaches the tapered pipe 122 and flows from the latter into the distribution header 124 of the headbox. This header 124 is adjustable together with the pipe 122 when the headbox itself is adjusted. The elongated tubular elastic wall means 113 is protected within the tank 110 by way of a substantially rigid means made up of the longitudinally extending rods 114 and the circular rings 115 which are connected to each other with the longitudinal elements 114 engaging the exterior surface of the tube 113 so as to support and protect the latter while still permitting expansion and contraction thereof as described above. The longitudinal bars or rods 114 which directly engage the exterior surface of the tube 113 are distributed about the latter while extending longitudinally in the direction of flow, whereas the rings 115 extend transversely to the direction of flow. Suitable supports 111 are provided to support tank 110.

Figure 12:
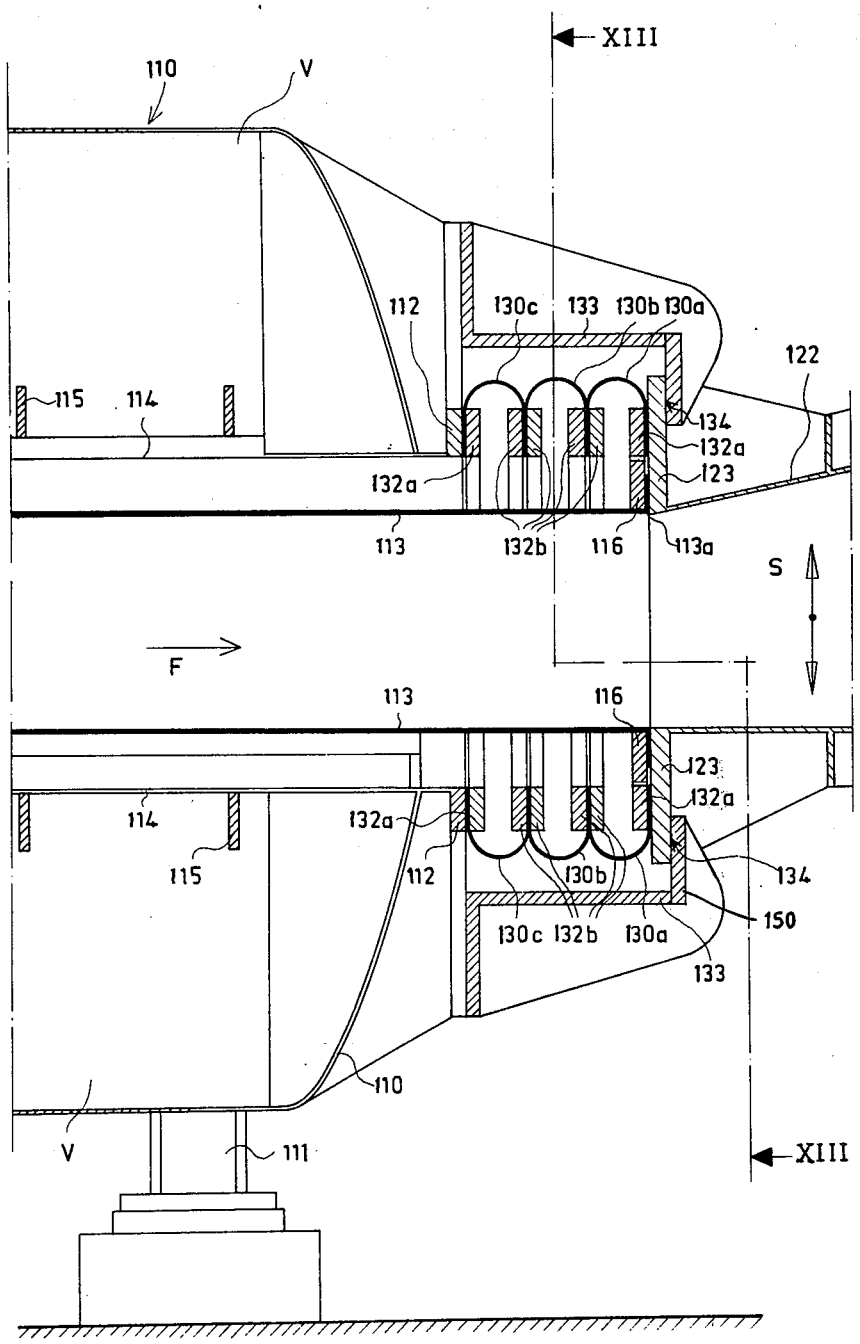
FIG. 12 is a fragmentary sectional elevation on a scale which is enlarged as compared to FIG. 11 and showing details of the elastic connecting structure of FIG. 11.
Figure 13:
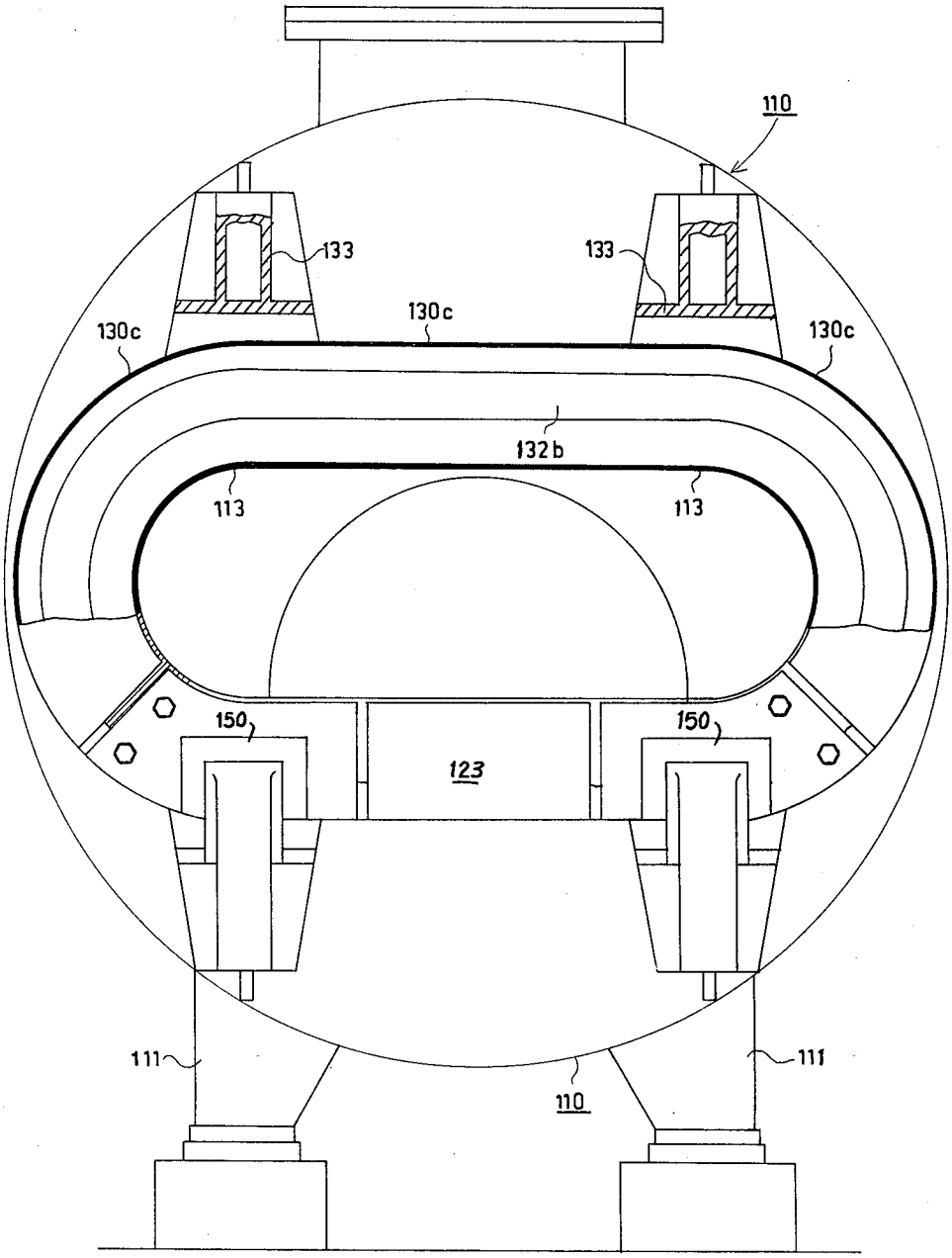
FIG. 13 is a schematic transverse section of part of the structure of FIG. 12 taken along line XIII—XIII of FIG. 12 in the direction of the arrows.

Referring to FIGS. 11–13, it will be seen that in this embodiment the end of the tank 110 which is nearest to the headbox is connected with the flange 123 at the inlet end of the pipe 122 by way of a flexible bellows means. Thus the outwardly directed flange 123 at the inlet end of the pipe 122 is fixed to a ring 116 which serves to clamp between the ring 116 and the flange 123 the outwardly directed flange 113*a* of the elastic tube 113. In addition, a ring 132*a* which surrounds the ring 116 is fixed by suitable bolts or the like to the flange 123 while clamping between the ring 132*a* and the flange 123 a sidewall of a flexible resilient convolution 130*a* of the bellows means which is illustrated in detail in FIG. 12. This bellows convolution 130*a* may be made, for example, of rubber, although other elastic material may also be used. The bellows convolution 130*a* forms one of a plurality of bellows convolutions which also include the convolutions 130*b* and 130*c*, and all of these convolutions of the bellows means surround and are spaced from the end region of the elastic tube 113 which is joined to the flange 123 of the pipe 122. The several bellows convolutions while being endless are of the illustrated substantially U-shaped cross section, and their adjoining side walls are clamped between the rings 132*b* which are bolted together so as to have the positions illustrated in FIG. 12, these rings 132*b* also surrounding and being spaced from the elastic wall means 113. It will be noted particularly from FIG. 13 that the general configuration of the bellows convolutions and rings 132*a*, 132*b* corresponds to the general configuration of the cross section of the elastic wall means 113 which in the illustrated example is substantially elliptical. The bellows convolution 130*c* has a sidewall directly engaging a flange 112 at the end of the tank 110 while a ring 132*a* serves to fluid-tightly fix the left side wall of the convolution 130*c* to the right end of the tank 110, as viewed in FIG. 12. The number of rubber bellows convolutions may vary as desired, depending upon the magnitude of the displacements of the headbox and the pipe 122 connected thereto. As indicated by the arrows S in FIG. 12, the pipe 122 together with the headbox can be adjusted vertically, but it is also possible to provide for horizontal adjustment in a direction normal to the plane of FIG. 12. It is to be noted that the hollow interior of the tank 110 communicates with the interior of the bellows means illustrated in FIG. 12 so that the several elastic convolutions of the bellows means are filled at their interior with the air under pressure which is supplied to the interior space V of the tank 110.

Figure 14:
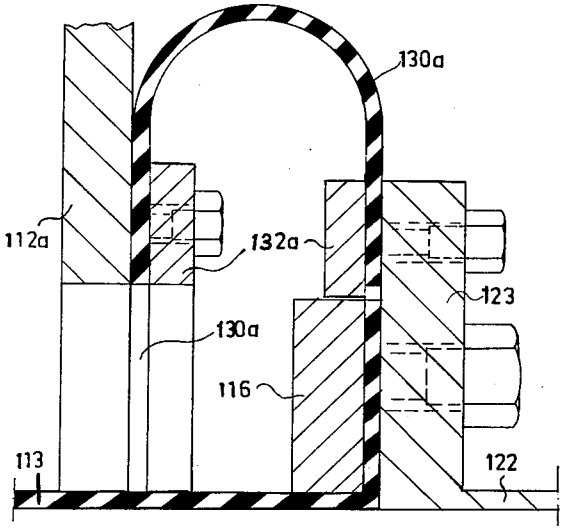
FIG. 14 is a fragmentary schematic sectional elevation in a plane parallel to the direction of suspension flow and illustrating at a scale which is enlarged as compared to FIG. 10 details of an elastic connecting structure of FIG. 10.

FIG. 14 illustrates an embodiment of the invention where the bellows means has only a single convolution 130*a*. This single rubber bellows 130*a* of FIG. 14 is fixed at one of its side walls between the ring 132*a* and the flange 123. This ring 132*a* of course surrounds the ring 116 which serves to fix the end flange of the elastic tube 113 to the flange 123 of the pipe 122 in the manner shown in FIG. 14. A ring 112*a* serves to fix the left side wall of the bellows 130*a* of FIG. 14 to the end 112*a* of the tank. It will be noted that the rigid rings 132*b* which connect the bellows convolutions to each other in FIG. 12 serve to maintain these convolutions in a configuration consistent with the cross-sectional configuration of the elastic pipe 113.

FIGS. 12 and 13 illustrate a limiting means for limiting the extent of adjustable movement. This limiting means includes a plurality of brackets 133 which are fixed to the right end of the tank 110 and extend therefrom longitudinally in the direction of suspension flow. These brackets 133 of the limiting means fixedly carry at their outer ends vertical plates 150 forming a slide plate means slidably engaging the surface 134 of the flange 123. Thus, the pressure within the tank and within the bellows means serves to urge the flange 123 of the pipe 122 against the slide plate means 150 fixedly carried by the limiting means 133, and thus the plate 123 can slide in a vertical plane at its surface 134 along the slide plate means 150 to provide for the adjusting movement while at the same time the extent of adjusting movement is limited by engagement of the outer edge of the flange 123 with the limiting brackets 133.

Thus, with the above elastic connecting structure of FIGS. 10–14 it is possible for the pipe 122 which is rigidly fixed to the distribution header 124 of the headbox to move in a direction of the arrows S of FIG. 12 and simultaneously in a horizontal direction perpendicular thereto. Similarly, minor torsion about the longitudinal axis of the tube 113 is possible. This possibility of adjustment is very favorably obtained by utilizing the above-described comparatively long elastic inner tube 113 of the damping apparatus of the invention as well as the elastic connecting means composed of the bellows means of the invention connected on the one hand to the flange 123 and on the other hand to the tank 110.

Of course, the invention is not to be narrowly confined to the details described above and shown in the drawings by way of example only, inasmuch as the invention may vary within the inventive concept defined by the claims which follow below.

What is claimed is:

1. In an apparatus for damping pressure fluctuations in a pulp-suspension to a headbox with the suspension flowing along the interior of a pipe system, enclosure means having a hollow interior for enclosing in said hollow interior a gas such as air at a pressure greater than atmospheric pressure, said pipe system including an elastic wall means formed of a substantially unstretchable material having substantial flexibility, said wall means having an inner surface defining part of the interior of said pipe system for engaging pulp suspension flowing through the interior of said pipe system and an outer surface exposed in the hollow interior of said enclosure means to the gas under pressure therein, said elastic wall means responding to an increase in the pressure of the suspension with respect to the pressure of the gas to increase the cross section of said suspension flow where the suspension engages said elastic wall means and responding to a decrease in the pressure in said enclosure means for decreasing said cross section so that through said elastic wall means pressure fluctuations in the flowing pulp suspension will be damped, said enclosure means having an outer wall surrounding the hollow interior thereof, said elastic wall means having an outer peripheral portion fixed to said outer wall of said enclosure means and surrounded thereby and an inner peripheral portion situated inwardly of and surrounded by said outer wall of said enclosure means, said pipe system including a pipe fixed at one end to said inner peripheral portion of said elastic wall means and extending therefrom through the interior of said enclosure means, and said pipe system including a second pipe having an end connected with said outer peripheral portion of said elastic wall means, said pipes respectively directing the suspension into and out of said enclosure means while exposing the suspension to the pressure of the gas in said enclosure means through said elastic wall means.

2. The combination of claim 1 and wherein said pipe system includes in its interior adjacent but spaced from said elastic wall means a baffle means defining with said elastic wall means an interior space of said system through which the suspension flows substantially radially between said peripheral portions of said elastic wall means.

3. In an apparatus for damping pressure fluctuations in a pulp-suspension flow in a paper machine, a pipe system for delivering the pulp suspension to a headbox with the suspension flowing along the interior of the pipe system, enclosure means having a hollow interior for enclosing in said hollow interior a gas such as air at a pressure greater than atmospheric pressure, said pipe system including an elastic wall means having an inner surface defining part of the interior of said pipe system for engaging pulp suspension flowing through the interior of said pipe system and an outer surface exposed in the hollow interior of said enclosure means to the gas under pressure therein, said elastic wall means responding to an increase in the pressure of the suspension with respect to the pressure of the gas for expanding to increase the cross section of said suspension flow where the suspension engages said elastic wall means and responding to a decrease in the pressure of the suspension with respect to the gas pressure in said enclosure means for decreasing said cross section so that through said elastic wall means pressure fluctuations in the flowing pulp suspension will be damped and wherein said pipe system has a portion adjacent said enclosure means which is movable with respect thereto in connection with headbox adjustment, said elastic wall means including a tubular portion for surrounding the pulp-suspension flow and having an end fixed with said portion of said pipe system for movement therewith while forming an extension thereof so that the pulp suspension flows without interruption in the interior of said elastic wall means and said portion of said pipe system, and flexible bellows means surrounding said elastic wall means at the region where it is connected with said portion of said pipe system, said bellows means being fixed at one end together with said elastic wall means to said portion of said pipe system and at an opposite end directly to said enclosure means while being spaced from and surrounding said elastic wall means.

4. The combination of claim 3 and wherein said bellows means includes a plurality of endless convolutions of substantially U-shaped cross section situated one next to the other while surrounding and spaced from said elastic wall means and having a configuration conforming generally to the cross-sectional configuration of an elastic wall means at least at the portion thereof surrounded by said bellows means, said convolutions having hollow interiors which are directed toward said elastic wall means, and said convolutions having side wall portions engaging each other, and a plurality of rings engaging and fixing said side wall portions of said convolutions to each other while also surrounding and being spaced from said elastic wall means and having a configuration corresponding generally to the cross-sectional configuration of said elastic wall means.

5. The combination of claim 3 and wherein said portion of said pipe system has, at its end which is fixed to said bellows means and elastic wall means, a flange which extends outwardly from said portion of said pipe system in a plane substantially parallel to the direction of adjusting movement of said portion of said pipe system, slide-plate means slidably engaging said flange and being parallel thereto, and limiting means normally spaced from said flange while being fixed to said enclosure means and carrying said slide-plate means and extending from said enclosure means substantially parallel to the direction of suspension flow for limiting the extent of adjustable movement of said portion of said pipe system.

6. The combination of claim 3 and wherein an elastic connection means is situated at an end of said enclosure means opposite from said bellows means for connecting said elastic wall means to said enclosure means while facilitating the mounting of said elastic wall means in a position extending through said enclosure means.

7. The combination of claim 6 and wherein said elastic connection means includes a bellows means identical with that which connects said elastic wall means to said portion of said pipe system.

8. The combination of claim 3 and wherein said bellows means has a hollow interior communicating with the hollow interior of said enclosure means while surrounding said elastic wall means.

* * * * *